US011781090B2

(12) United States Patent
Randall et al.

(10) Patent No.: US 11,781,090 B2
(45) Date of Patent: Oct. 10, 2023

(54) PROCESS OF REDUCING MALODORS ON FABRICS

(71) Applicant: The Procter & Gamble Company, Cincinnati, OH (US)

(72) Inventors: Sherri Lynn Randall, Hamilton, OH (US); Gregory Scot Miracle, Liberty Township, OH (US); Brian Joseph Loughnane, Sharonville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 387 days.

(21) Appl. No.: 17/098,531

(22) Filed: Nov. 16, 2020

(65) Prior Publication Data

US 2021/0198594 A1 Jul. 1, 2021

(30) Foreign Application Priority Data

Nov. 18, 2019 (EP) ..... 19209628

(51) Int. Cl.

| | |
|---|---|
| ***B08B 3/04*** | (2006.01) |
| ***C11D 1/00*** | (2006.01) |
| ***C11D 1/22*** | (2006.01) |
| ***C11D 1/29*** | (2006.01) |
| ***C11D 1/37*** | (2006.01) |
| ***C11D 3/30*** | (2006.01) |
| ***C11D 1/83*** | (2006.01) |
| ***C11D 3/00*** | (2006.01) |

(52) U.S. Cl.

CPC ..... *C11D 1/008* (2013.01); *C11D 1/29* (2013.01); *C11D 1/8305* (2013.01); *C11D 3/0068* (2013.01); *C11D 3/0084* (2013.01)

(58) Field of Classification Search

CPC .... C11D 1/00; C11D 1/22; C11D 1/29; C11D 1/37; C11D 3/0084; C11D 3/30; C11D 3/3723; B08B 3/04

See application file for complete search history.

(56) References Cited

U.S. PATENT DOCUMENTS

| | | | | |
|---|---|---|---|---|
| 6,525,013 | B1 * | 2/2003 | Littig | C11D 3/3723 510/330 |
| 6,875,735 | B1 * | 4/2005 | Frankenbach | C11D 3/2044 510/522 |
| 9,821,081 | B2 | 11/2017 | Williams | |
| 2014/0147408 | A1 * | 5/2014 | Williams | C11D 3/222 424/76.1 |
| 2015/0099689 | A1 * | 4/2015 | Madhav | C11D 3/3773 512/27 |
| 2016/0230122 | A1 | 8/2016 | Bianchetti | |
| 2019/0282989 | A1 | 9/2019 | Feng | |

FOREIGN PATENT DOCUMENTS

| | | | | |
|---|---|---|---|---|
| WO | WO 97/42298 | * | 11/1997 | C11D 10/04 |
| WO | 2016049389 | A1 | 3/2016 | |
| WO | 2016061439 | | 4/2016 | |
| WO | 2020081294 | A1 | 4/2020 | |

OTHER PUBLICATIONS

EP Search Report for appl. No. 19209628. 7-1105, dated May 12, 2020, 8 pages.

BASF, Retrieved from the Internet: URL:https://chemical.carytrad.com.tw/uploads/1/2/3/8/123848866/tds_lupasol_types_en.pdf, Sep. 1, 2020, XP055394146.

International Search Report and Written Opinion; Application Ser. No. PCT/US2020/070711; dated Feb. 16, 2021, 16 pages.

* cited by examiner

*Primary Examiner* — Brian P Mruk

(57) ABSTRACT

The present invention relates to a process for reducing malodors on fabrics using a detergent composition containing a polyalkyleneamine and use of the polyalkyleneamine in the process.

19 Claims, No Drawings

PROCESS OF REDUCING MALODORS ON FABRICS

FIELD OF THE INVENTION

Disclosed is a process for reducing malodors on fabrics using a detergent composition containing a polyamine and use of said polyamine and said process.

BACKGROUND OF THE INVENTION

Laundry wash processes are designed to eliminate soils from fabrics. Some soils can cause malodors on fabrics and in some instances these malodors can persist even after the laundry wash operation.

Therefore, there is an on-going need for processes to reduce malodors on fabrics.

It was surprisingly found that the process disclosed provided reduced malodors on fabrics.

Without wishing to be bound by theory, it is believed that the use of the specific choice of polyamine through the wash provides reduced malodor on the fabrics treated with the process.

SUMMARY OF THE INVENTION

A first aspect is a process of reducing malodors on fabrics, comprising the steps of a. Combining fabrics with a wash liquor, wherein the fabrics comprise at least one source of malodor and wherein the wash liquor is prepared by diluting a laundry detergent composition in water by a factor of between 100- and 3000-fold, preferably between 300- and 900-fold;

b. Washing the fabrics in the wash liquor using an automatic wash operation, a manual wash operation of a mixture thereof, preferably an automatic wash operation;

c. Separating the fabrics and the wash liquor from one another;

wherein the laundry detergent composition comprises between 0.01% to 1.1% by weight of the laundry detergent composition of a polyamine or salt thereof.

DETAILED DESCRIPTION OF THE INVENTION

Process

Disclosed is a process of reducing malodors on fabrics.

A 'malodor', as described herein, is an undesired or undesirable smell on the fabrics. Those skilled in the art will be aware of what an undesirable smell is as compared to a desirable smell.

The process comprises the steps of;

a. Combining fabrics with a wash liquor, wherein the fabrics comprise at least one source of malodor and wherein the wash liquor comprises a source of metal ions, preferably $Cu^{2+}$ and wherein the wash liquor is prepared by diluting a laundry detergent composition in water by a factor of between 100- and 3000-fold, preferably between 300- and 900-fold. The fabric may be any suitable fabric. By fabric we preferably mean a textile or cloth comprising a network of natural and/or synthetic fibers. Those skilled in the art will be aware of suitable fabrics. The fabric may be selected from cotton, polyester, cotton/polyester blends, polyamide, elastane, rayon, or a mixture thereof.

The fabric comprises at least one source of malodor. Those skilled in the art will be aware of suitable sources of malodor. Sources of malodor could include the products of chemical breakdown of body soils. The source of malodor may comprise body soil or its degradation products, for example, 6-Methyl-5-heptane-2-one, Trans-2-heptanal, 3-methyl-2-Butenal, Decanoic Acid, Undecanoic Acid, Undecanal or a mixture thereof.

Those skilled in the art will know how to make the wash liquor. Without wishing to be bound by theory, addition of the laundry detergent composition to water, or addition of water to laundry detergent, will cause the laundry detergent composition to dissolve and create the wash liquor.

The wash liquor can be created automatically in the drum of an automatic washing machine or can be made in a manual wash operation.

The laundry detergent composition may be comprised in a water-soluble unit dose article, wherein the water-soluble unit dose article comprises a water-soluble film. Without wishing to be bound by theory, combining the water-soluble unit dose article with water will cause the water-soluble film to dissolve and release the laundry detergent composition into the water creating the main wash liquor. When made in the drum of an automatic washing machine, traditionally, the fabrics to be washed and the water-soluble unit dose article are added to the drum and the door of the washing machine closed. The washing machine then automatically adds water to the drum to create the wash liquor.

Preferably the wash liquor comprises between 1 L and 64 L, preferably between 2 L and 32 L, more preferably between 3 L and 20 L of water.

The laundry detergent composition is described in more detail below.

The wash liquor comprises a metal ion, preferably $Cu^{2+}$. The metal ion may be present on the fabric before the fabric is contacted with the wash liquor. The metal ion may be present in the source of malodor on the fabric before the fabric is combined with the wash liquor. The metal ion may be present in the wash liquor when combined with the fabric. If present in the wash liquor, the metal ion may be present in the laundry detergent, the water or a mixture thereof. The water used to make the wash liquor may comprise between 20 ppb and 10,000 ppb, preferably between 50 ppb and 1000 ppb of the metal ion. Without wishing to be bound by theory, tap water comprises between 1 ppb and 1500 ppb, preferably between 50 ppb and 500 ppb of $Cu^{2+}$. The source of malodor may comprise the metal ion at the point the source of malodor is applied to the fabric. Alternatively, the source of malodor may be applied to the fabric, such as may occur during wear when the fabric can be in contact with the skin of the wearer, and the metal ion applied later.

Preferably, the wash liquor comprises from 0.1 ppm to 100 ppm, preferably from 0.15 ppm to 50 ppm of the polyamine.

b. Washing the fabrics in the wash liquor using an automatic wash operation, a manual wash operation or a mixture thereof, preferably an automatic wash operation.

Those skilled in the art will know how to wash fabrics in an automatic wash operation, a manual wash operation or a mixture thereof.

Preferably, the wash liquor is at a temperature of between 5° C. and 90° C., preferably between 10° C. and 60° C., more preferably between 12° C. and 45° C., most preferably between 15° C. and 40° C.

Preferably, washing the fabrics in the wash liquor takes between 5 minutes and 50 minutes, preferably between 5 minutes and 40 minutes, more preferably between 5 minutes and 30 minutes, even more preferably between 5 minutes and 20 minutes, most preferably between 6 minutes and 18 minutes to complete.

Preferably, the wash liquor comprises between 1 kg and 20 kg, preferably between 3 kg and 15 kg, most preferably between 5 and 10 kg of the fabrics.

The wash liquor may comprise water of any hardness preferably varying between 0 gpg to 40 gpg. A lower water hardness is termed soft water whereas a higher water hardness is termed hard water.

c. Separating the fabrics and the wash liquor from one another.

The fabrics and the wash liquor are separated from one another following washing of the fabrics. Such separation may involve removing the fabrics from the wash liquor or draining the wash liquor away from the fabrics. In an automatic washing machine operation, it is preferred that the wash liquor is drained away from the fabrics. In the avoidance of doubt, some of the wash liquor may remain soaked into the fabrics following separation of the fabrics and the main wash liquor, i.e. the fabrics remain wet. The fabrics and wash liquor are deemed separated from one another once the fabric is separate from the main volume of the wash liquor or the main volume of the wash liquor has been drained away, despite some residual wash liquor possibly remaining soaked into the fabrics.

d. Rinsing the fabrics

The method may include an additional step comprising the rinsing of the fabrics by a liquid that may not contain a detergent. The additional step may serve the purpose of removing any residual wash liquor in the fabrics. The liquid used during the rinsing step may be water. Additionally, the liquid may be a combination of water with one or more additives such as a fabric softening agent.

e. Drying the fabrics.

The method may include an additional step comprising drying the fabrics. Those skilled in the art will be aware of suitable means to dry the fabrics. The fabrics may be dried by any suitable means including but not limited to: on a line (indoor or outdoor), at room temperature, in an automatic drying machine or a mixture thereof. Those skilled in the art will know at what point the fabrics are deemed dry as opposed to wet.

Laundry Detergent Composition

The process comprises the step of diluting a laundry detergent composition.

The laundry detergent composition may be a powder, a liquid, a water-soluble unit dose article or a mixture thereof.

The solid laundry detergent composition may comprise solid particulates or may be a single homogenous solid. Preferably, the solid laundry detergent composition comprises particles. This means the solid laundry detergent composition comprises individual solid particles as opposed to the solid being a single homogenous solid. The particles may be free-flowing or may be compacted, preferably free-flowing.

The term 'liquid laundry detergent composition' refers to any laundry detergent composition comprising a liquid capable of wetting and treating a fabric, and includes, but is not limited to, liquids, gels, foams, pastes, dispersions and the like. The liquid composition can include solids or gases in suitably subdivided form, but the liquid composition excludes forms which are non-fluid overall, such as powders, tablets or granules.

The water-soluble unit dose article is described in more detail below.

The laundry detergent composition comprises between 0.01% to 5%, more preferably from 0.03% to 1%, most preferably from 0.05% to 0.5% by weight of the laundry detergent composition of a polyamine or salt thereof. The polyamine or salt thereof is described in more detail below.

The laundry detergent composition preferably comprises a non-soap surfactant. More preferably, the non-soap surfactant is selected from non-soap anionic surfactant, non-ionic surfactant, amphoteric surfactant, cationic surfactant, or a mixture thereof. The laundry detergent composition preferably comprises between 8% and 60%, more preferably between 15% and 55% by weight of the laundry detergent composition of the non-soap surfactant.

Preferably, the non-soap anionic surfactant comprises linear alkylbenzene sulphonate, alkoxylated alkyl sulphate, alkyl sulfate, or a mixture thereof. Preferably, the alkyl sulphate is an ethoxylated alkyl sulphate.

Preferably, the laundry detergent composition comprises between 5% and 50%, preferably between 8% and 45%, more preferably between 15% and 40%, most preferably between 20% and 40% by weight of the detergent composition of the non-soap anionic surfactant.

Preferably, the non-soap anionic surfactant comprises linear alkylbenzene sulphonate and alkoxylated alkyl sulphate, wherein the ratio of linear alkylbenzene sulphonate to alkoxylated alkyl sulphate is from 1:2 to 20:1, preferably from 1.1:1 to 15:1, more preferably from 1.2:1 to 10:1, even more preferably from 1.3:1 to 5:1, most preferably from 1.4:1 to 3:1.

Preferably, the laundry detergent composition comprises between 0% and 10%, preferably between 0.01% and 8%, more preferably between 0.1% and 6%, most preferably between 0.15% and 4% by weight of the laundry detergent composition of a non-ionic surfactant. The non-ionic surfactant is preferably selected from alcohol alkoxylate, an oxo-synthesized alcohol alkoxylate, Guerbet alcohol alkoxylates, alkyl phenol alcohol alkoxylates or a mixture thereof.

Preferably, liquid laundry detergent composition comprises between 0.5% and 20%, more preferably between 1% and 15%, even more preferably between 2% and 10%, most preferably between 3% and 8% by weight of the laundry detergent composition of soap, preferably a fatty acid salt, more preferably an amine neutralized fatty acid salt, wherein preferably the amine is an alkanolamine more preferably selected from monoethanolamine, diethanolamine, triethanolamine or a mixture thereof, more preferably monoethanolamine.

The laundry detergent composition preferably comprises an ingredient selected from the list comprising cationic polymers, polyester terephthalates, amphiphilic graft copolymers, carboxymethylcellulose, enzymes, perfumes, encapsulated perfumes, bleach or a mixture thereof Without wishing to be bound by theory it is believed further addition of these materials can further facilitate malodor reduction. One skilled in the art will know how best to combine such ingredients to ensure chemical compatibility.

The laundry detergent composition may comprise an adjunct ingredient, wherein the adjunct ingredient is selected from non-aqueous solvents, water, hueing dyes, aesthetic dyes, enzymes, cleaning polymers, builders like fatty acid, chelants, bleach, dispersants, dye transfer inhibitor polymers, fluorescent whitening agent, opacifier, structurant, antifoam or a mixture thereof.

Preferably, the laundry detergent composition may comprise a chelant, wherein the chelant is preferably selected from phosphonates, aminocarboxylates, amino phosphonates, polyfunctionally-substituted aromatic chelating agents, or mixtures thereof. More preferably the laundry detergent composition may comprise an additional chelating agent selected from DTPA (diethylenetriaminepentaacetic acid), HEDP (hydroxyethanediphosphonic acid), EDDS (ethylenediamine disuccinate), DTPMP (diethylene triamine penta (methylene phosphonic acid)), EDTMP (ethylene diamine tetra(methylene phosphonic acid)), Tiron® (1,2-diydroxybenzene-3,5-disulfonic acid), HPNO (2-pyridinol-N-oxide), MGDA (methylglycinediacetic acid), GLDA (glutamic-N,N-diacetic acid), EDTA (ethylenediamine tetraacetate), any suitable derivative thereof, salts thereof, and mixtures thereof. Preferably, the chelating agent is biodegradable.

The laundry detergent composition may comprise an antioxidant. Without wishing to be bound by theory, it is believed that antioxidants may help to improve malodor control and/or cleaning performance of the compositions, particularly in combination with the polyamines of the present disclosure. Antioxidants may also help to reduce yellowing that may be associated with amines, allowing the amines to be formulated at a relatively higher level.

The laundry detergent composition may comprise a hindered phenol antioxidant in an amount of from 0.001% to 2%, preferably from 0.01% to 0.5%, by weight of the laundry detergent composition.

Suitable antioxidants may include alkylated phenols, having the general formula:

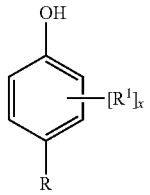

wherein R is $C_1$-$C_{22}$ linear alkyl or $C_3$-$C_{22}$ branched alkyl, each (1) having optionally therein one or more ester (—$CO_2$—) or ether (—O—) links, and (2) optionally substituted by an organic group comprising an alkyleneoxy or polyalkyleneoxy group selected from EO (ethoxy), PO (propoxy), BO (butoxy), and mixtures thereof, more preferably from EO alone or from EO/PO mixtures; R may preferably be methyl, branched $C_3$-$C_6$ alkyl, or $C_1$-$C_6$ alkoxy, preferably methoxy; $R^1$ is a $C_3$-$C_6$ branched alkyl, preferably tert-butyl; x is 1 or 2.

Preferred types of alkylated phenols having this formula may include hindered phenolic compounds. As used herein, the term "hindered phenol" is used to refer to a compound comprising a phenol group with either (a) at least one $C_3$ or higher branched alkyl, preferably a $C_3$-$C_6$ branched alkyl, preferably tert-butyl, attached at a position ortho to at least one phenolic —OH group, or (b) substituents independently selected from the group consisting of a $C_1$-$C_6$ alkoxy, preferably methoxy, a $C_1$-$C_{22}$ linear alkyl or $C_3$-$C_{22}$ branched alkyl, preferably methyl or branched $C_3$-$C_6$ alkyl, or mixtures thereof, at each position ortho to at least one phenolic —OH group. If a phenyl ring comprises more than one —OH group, the compound is a hindered phenol provided at least one such —OH group is substituted as described immediately above. Where any R group in the structure above comprises three or more contiguous monomers, that antioxidant is defined herein as a "polymeric hindered phenol antioxidant." Compositions according to the present disclosure may include a hindered phenol antioxidant. A preferred hindered phenol antioxidant includes 3,5-di-tert-butyl-4-hydroxytoluene (BHT).

A further class of hindered phenol antioxidants that may be suitable for use in the composition is a benzofuran or benzopyran derivative having the formula:

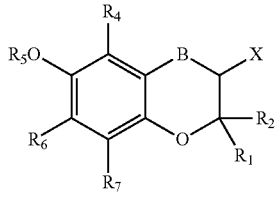

wherein $R_1$ and $R_2$ are each independently alkyl or $R_1$ and $R_2$ can be taken together to form a $C_5$-$C_6$ cyclic hydrocarbyl moiety; B is absent or $CH_2$; $R_4$ is $C_1$-$C_6$ alkyl; $R_5$ is hydrogen or —C(O)$R_3$ wherein $R_3$ is hydrogen or $C_1$-$C_{19}$ alkyl; $R_6$ is $C_1$-$C_6$ alkyl; $R_7$ is hydrogen or $C_1$-$C_6$ alkyl; X is —$CH_2$OH, or —$CH_2$A wherein A is a nitrogen-comprising unit, phenyl, or substituted phenyl. Preferred nitrogen-comprising A units include amino, pyrrolidino, piperidino, morpholino, piperazino, and mixtures thereof.

Suitable hindered phenol antioxidants may include: 2,6-bis(1,1-dimethylethyl)-4-methyl-phenol; 3,5-bis(1,1-dimethylethyl)-4-hydroxy-benzenepropanoic acid, methyl ester; 3,5-bis(1,1-dimethylethyl)-4-hydroxybenzenepropanoic acid, octadecyl ester; or mixtures thereof.

Commercially available antioxidants that may be suitable include BHT, RALOX 35™, and/or TINOGARD TS™.

Additional antioxidants may be employed. Examples of suitable antioxidants for use in the composition include, but are not limited to, the group consisting of tocopherol, ethoxyquin, 2,2,4-trimethyl-1,2-dihydroquinoline, 2,6-di-tert-butyl hydroquinone, tert-butyl hydroxyanisole, lignosulphonic acid and salts thereof, and mixtures thereof. It is noted that ethoxyquin (1,2-dihydro-6-ethoxy-2,2,4-trimethylquinoline) is marketed under the name Raluquin™ by the company Raschig™. Other types of antioxidants that may be used in the composition are 6-hydroxy-2,5,7,8-tetramethyl-chroman-2-carboxylic acid (Trolox™) and 1,2-benzisothiazoline-3-one (Proxel GXL™). Antioxidants such as tocopherol sorbate, butylated hydroxyl benzoic acids and their salts, gallic acid and its alkyl esters, uric acid and its salts, sorbic acid and its salts, and dihydroxyfumaric acid and its salts may also be useful.

The use of non-yellowing antioxidants, such as non-yellowing hindered phenol antioxidants, may be preferred. Antioxidants that form such yellow by-products may be avoided if they lead to perceptible negative attributes in the consumer experience (such as deposition of yellow by-products on fabric, for example). The skilled artisan is able to make informed decisions regarding the selection of antioxidants to employ.

The liquid laundry detergent composition preferably has a pH between 6 and 10, more preferably between 6.5 and 8.9, most preferably between 7 and 8.5, wherein the pH of the liquid laundry detergent composition is measured as a 10% dilution in demineralized water at 20° C.

Water-Soluble Unit Dose Article

The water-soluble unit dose article comprises a water-soluble film and a laundry detergent composition. The laundry detergent composition and the water-soluble film are described in more detail below.

The water-soluble unit dose article comprises the water-soluble film shaped such that the unit-dose article comprises at least one internal compartment surrounded by the water-soluble film, and wherein the laundry detergent composition is present within said compartment. The unit dose article may comprise a first water-soluble film and a second water-soluble film sealed to one another such to define the internal compartment. The water-soluble unit dose article is constructed such that the laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the detergent composition. During manufacture, a first water-soluble film may be shaped to comprise an open compartment into which the detergent composition is added. A second water-soluble film is then laid over the first film in such an orientation as to close the opening of the compartment. The first and second films are then sealed together along a seal region.

The unit dose article may comprise more than one compartment, even at least two compartments, or even at least three compartments. The compartments may be arranged in superposed orientation, i.e. one positioned on top of the other. In such an orientation the unit dose article will comprise three films, top, middle and bottom. Alternatively, the compartments may be positioned in a side-by-side orientation, i.e. one orientated next to the other. The compartments may even be orientated in a 'tire and rim' arrangement, i.e. a first compartment is positioned next to a second compartment, but the first compartment at least partially surrounds the second compartment, but does not completely enclose the second compartment. Alternatively, one compartment may be completely enclosed within another compartment. Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the laundry detergent composition may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

The water-soluble unit dose article may comprise at least two internal compartments, wherein the liquid laundry detergent composition is comprised in at least one of the compartments, preferably wherein the unit dose article comprises at least three compartments, wherein the detergent composition is comprised in at least one of the compartments.

The film may be soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers and/or copolymers can also be used as the pouch material, especially mixtures of polyvinylalcohol polymers and/or copolymers, especially mixtures of polyvinylalcohol homopolymers and/or anionic polyvinylalcohol copolymers preferably selected from sulphonated and carboxylated anionic polyvinylalcohol copolymers especially carboxylated anionic polyvinylalcohol copolymers. Most preferably the water soluble film comprises a blend of a polyvinylalcohol homopolymer and a carboxylated anionic polyvinylalcohol copolymer.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

The film may be opaque, transparent or translucent. The film may comprise a printed area.

The area of print may be achieved using standard techniques, such as flexographic printing or inkjet printing.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 ppm.

Polyalkyleneamine

The laundry detergent composition comprises polyalkyleneamine. The polyalkyleneamine may be comprised of alkyleneamine moieties selected from a.

(M1)

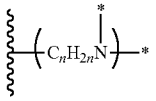

b.

(M2)

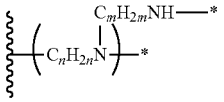

c.

(M3)

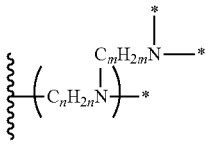

wherein for each alkyleneamine moiety, n is independently 2 or 3, preferably 2; m is independently 2 or 3, preferably 2; wherein the polyamine comprises at least one radical

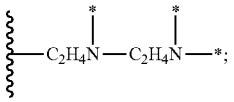

wherein

├ indicates a point of attachment either to (a) a N atom of another M1, M2, or M3, or to (b) $NG_2$;

—* indicates a point of attachment either to (a) a C atom of another M1, M2, or M3, or to (b) G;

each G independently is H or an organic capping group with MW less than 250, preferably H;

the number of M1 alkyleneamine moieties is an integer from about 1 to about 120,000, preferably from about 2 to about 60,000, more preferably from about 3 to about 24,000; the sum of the number of M2 and M3 alkyleneamine moieties is an integer from about 0 to about 60,000, preferably from about 1 or 2 to about 30,000, more preferably from about 3 to about 12,000.

Alternatively, the Polyalkyleneamine may be comprised of alkyleneamine moieties selected from a.

(M1)

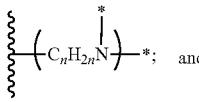

and

-continued b.

(M2)

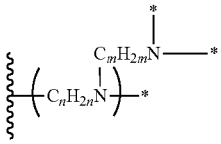

wherein for each alkyleneamine moiety, n is independently 2 or 3, preferably 2; m is independently 2 or 3, preferably 2; wherein the polyamine comprises at least one radical

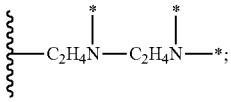

wherein

├ indicates a point of attachment either to (a) a N atom of another M1 or M2, or to (b) $NG_2$;

—* indicates a point of attachment either to (a) a C atom of another M1 or M2, or to (b) G;

each G independently is H or an organic capping group with MW less than 250, preferably H;

the number of M1 alkyleneamine moieties is an integer from about 1 to about 120,000, preferably from about 2 to about 60,000, more preferably from about 3 to about 24,000; the number of M2 alkyleneamine moieties is an integer from about 0 to about 60,000, preferably from about 1 or 2 to about 30,000, more preferably from about 3 to about 12,000.

The polyalkyleneamine may have a MW between about 160 to 50,000 such as, for example between 160 to 40,000, or between 600 to 25,000. The polyalkyleneamine may be present in the composition at 0.01 to 1.1 wt %, or from 0.025 to 1.0 wt %

The polyalkyleneamine may have no more than one organic capping group per three N atoms. Further, the composition may utilize more than one polyalkyleneamine or a plurality or a mixture of polyalkyleneamines. The polyalkyleneamine may be a polyethyleneimine (PEI) wherein all n and m are 2. Further description of PEIs is found below. The polyalkyleneamine may optionally be composed of no more than 10 M1 and/or M2 units. The polyalkyleneamine may optionally be composed of as few as two (2) M1 and/or M2 units.

Polyethyleneimines (PEI's)

The detergent composition may comprise one or more polyalkyeneamines in the form of polyethyleneimines (PEIs). PEIs for use in the detergent compositions may have the general formula, although the actual formula is not exactly known:

$$(—NHCH_2CH_2—)_x[—N(CH_2CH_2NH_2)CH_2CH_2—]_y$$

wherein x is an integer from about 1 to about 120,000, preferably from about 2 to about 60,000, more preferably from about 3 to about 24,000 and y is an integer from about 1 to about 60,000, preferably from about 2 to about 30,000, more preferably from about 3 to about 12,000. Specific examples of polyethyleneimines are PEI-3, PEI-7, PEI-15, PEI-30, PEI-45, PEI-100, PEI-300, PEI-500, PEI 600, PEI-700, PEI-800, PEI-1000, PEI-1500, PEI-1800, PEI-2000, PEI-2500, PEI-5000, PEI-10,000, PEI-25,000, PEI 50,000, PEI-70,000, PEI-500,000, PEI-5,000,000 and the like, wherein the integer represents the average molecular weight of the polymer. PEI's which are designated as such are available through Aldrich.

PEIs are polyamines comprising some repeating units with the empirical formula $(C_2H_5N)_n$ with a molecular mass of 43.07 (as repeating units). They are commercially prepared by acid-catalyzed ring opening of ethyleneimine, also known as aziridine. (The latter, ethyleneimine, is prepared through the sulfuric acid esterification of ethanolamine).

Polyethyleneimines can have an average molecular weight of about 100 to about 5,000,000 or even higher. Any polyethyleneimine is suitable for use, however the preferred polyethyleneimines are branched and have a typical average molecular weight of up to about 3,000,000, preferably from about 300 to about 2,500,000, more preferably from about 400 to about 1,000,000.

PEIs are commercially available from the BASF Corporation under the trade name Lupasol® (also sold as Polymin®). These compounds can be prepared with a wide range of molecular weights and product activities. Examples of commercial PEIs sold by BASF include, but are not limited to, Lupasol FG®, Lupasol G-35®), Lupasol-P®, Lupasol-PS®, Lupasol-(Water-Free)® and the like.

PEIs are also commercially available from Polymer Enterprises or Nippon Soda (of Japan) under the trade name Epomin®. Examples of commercial PEIs sold by Polymer Enterprises or Nippon Soda suitable for use in the present invention include, but are not limited to Epomin SP012®, Epomin P1050®, Epomin SP103®, Epomin SP003®, Epomin SP006® and the like.

Other frequently used commercial trade names for PEI suitable for use in present invention include, but are not limited to Polyazinidine®, Corcat®, Montek®, Polymin P® and the like.

The amine groups of PEI exist mainly as a mixture of primary, secondary and tertiary groups in the ratio of about 1:1:1 to about 1:2:1 with branching every 3 to 3.5 nitrogen atoms along a chain segment. Because of the presence of amine groups, PEI can be protonated with acids to form a PEI salt from the surrounding medium resulting in a product that is partially or fully ionized depending on pH. For example, about 73% of PEI is protonated at pH 2, about 50% of PEI is protonated at pH 4, about 33% of PEI is protonated at pH 5, about 25% of PEI is protonated at pH 8 and about 4% of PEI is protonated at pH 10. Therefore, since the detergent compositions of the present invention are buffered at a pH of about 6 to about 11, this suggests that PEI is about 4-30% protonated and about 70-96% unprotonated.

In general, PEIs can be purchased as their protonated or unprotonated form with and without water. When protonated PEIs are formulated in the compositions of the present invention they are deprotonated to a certain extent by adding a sufficient amount of suitable base. The deprotonated form of PEI is the preferred form, however moderate amounts of protonated PEI can be used and do not significantly detract from the present invention.

Examples of protonated PEI salts include, but are not limited to, PEI-hydrochloride salt, PET-sulfuric acid salt, PEI-nitric acid salt, PEI-acetic acid salt PEI fatty acid salt, PEI-HLAS surfactant salt and the like. In fact, any acid can be used to protonate PEIs resulting in the formation of the corresponding PEI salt compound. The counterion of each protonated nitrogen center is balanced with an anion of an acid obtained during neutralization.

Test Methods

Whiteness Loss Test Method Test

The following procedures are followed to test for whiteness losses (e.g., ΔWI).

A. Preparation of Whiteness Test Fabrics

De-sized Cotton, Polycotton and Polyester whiteness test fabrics can be ordered from WFK. (WFK Testgewebe GmbH, Christenfeld 10, D-41379 Bruggen, Germany). Four of each fabric type (12 fabrics total) are prepared for the whiteness test by washing them four times in 48 grams (750 ppm) of Tide Free and Clear and 25 grams (390 ppm) Downy Free rinse in a Kenmore Top Loader set to Normal wash cycle, 77 F wash, 60 F rinse, 7 grains per gallon. An initial whiteness reference measurement is made using Konica Minolta spectrophotometer and reported as Initial Whiteness Index CIE. The Whiteness Index CIE value is a common index of whiteness and refers to measurements made under D65 illumination, the standard representation of outdoor daylight. For a perfect reflecting, non-fluorescent white material, the CIE Whiteness would be 100. In technical terms, whiteness is a single number index referencing the relative degree of whiteness of near-white materials under specific lighting conditions. The index has been devised such that most people will agree that the higher the whiteness index, the whiter the material.

B. Whiteness Test

Fabrics are placed in a 7.57 liter custom washing tub under the conditions summarized in Table 3 below. Fabrics are washed with 5.65 grams (746 ppm) of detergent (liquid TIDE®) in the wash cycle together with background soil, followed by 3 grams (396 ppm) liquid fabric softener (DOWNY® Free) in the rinse cycle. Once the rinse cycle is complete, all the fabrics are removed and placed in a tumble dryer. This is repeated for 10 wash, rinse and dry cycles. After 10 cycles, fabrics are measured for whiteness loss using a Konica Minolta spectrophotomer and the measurement is reported as Final Whiteness Index. An average delta WI (i.e., ΔWI), representing the difference in the whiteness index measurements between the initial and treated, is calculated for each fabric tested, and represented by the following calculation: ΔWI=Initial Whiteness Index after preparation−Treated Whiteness Index after 10-20 cycles. Typically, ΔWI is a negative value as the whiteness tends to decrease after washing with background soil. The whiteness index is reported in the table as ΔΔWI=ΔWI test with polyalkyleneamine−ΔWI REF (nil polyalkyleneamine). ΔΔW is a negative value if the whiteness tends to decrease after washing with a test liquid detergent composition containing a polyalkyleneamine compared to a reference liquid detergent composition that does not contain an polyalkyleneamine. Numbers close to zero would represent an polyalkyleneamine which has little impact on fabric yellowing.

TABLE C

Wash, Rinse and Drying Conditions

| | Setting |
|---|---|
| Agitation (strokes per min) | 80 spm (Normal) |
| Wash Temperature | 60 F. |
| Water Hardness | 7 gpg |
| Rinse Temperature | 60 F. |
| Wash Cycle Time | 45 second liquid pre-dissolve, 18 min cycle |
| Rinse Cycle Time | 2 min cycle |
| Tub Volume | 7.57 liters |

TABLE C-continued

| Wash, Rinse and Drying Conditions | |
|---|---|
| | Setting |
| Drying Time | 35-40 min High heat setting (or until dry) |
| Background Soil | 1 Artificial Body Soil Terry Artificial body soil terry is commercially available by Accurate Product Development; 2028 Bohlke Blvd, Fairfield, OH 45014. 1 SBL2004 sheets from WFK Testgewebe GmbH Optionally, dingy fabrics as supplied by consumers |
| Internal fabric replicates | 4 Cotton (CW 120), 4 Polycotton (PC 50/50), 4 Polyester (PW 19) |

Malodor Removal Washing Test

The objective of the malodor removal washing test is to cross-compare the ability of different wash processes to reduce malodor on fabrics. A malodor cocktail is applied on laundry items to be washed in a subsequent full scale wash, after which the amount of remaining malodor actives on dried fabrics is analytically determined through GC-MS headspace SPME analysis. Each product is tested on 4 different washing machines, each washing machine comprising 16 malodor tracers (hence 64 replicates in total), and individual results are averaged and reported.

1) Washing Step:

Washing machine: High Efficiency Front Loading machine (Duet9200)

Washing cycle: normal cycle, 19.6 L water in wash cycle, 7 gpg, 25° C., 3.9 kg mixed cotton/polycotton ballast load (50×50 cm knit swatches: 17 cotton/12 polycotton), 16 malodor tracers (2×5 inch polycotton (50/50) swatches)

Washing product: one soluble unit dose comprising 25.4 g of test detergent or ~50 g of a liquid detergent 2) Drying Step:

Drying machine: Maytag Double Stack

Drying cycle: 20 minutes at 60-65° C. (setting: LOW)—16 washed malodor tracers together with 4 clean, dry hand towels Storage: dried swatches are placed in a Mylar bag (Polyester resin coated aluminum bags used to store fabrics until evaluation) sealed with a heat sealer for storage prior to analytical testing.

The water used to create the wash liquor contains 50 ppb of $Cu^{2+}$.

3) Analytical Malodor Characterization:

The principle behind the analytical malodor characterization technique is that the physical properties of malodor components require the component to have a low vapor pressure and/or a low odor detection threshold. Having these properties allows for the malodor to partition into the headspace. Therefore, headspace measurements above fabrics can be made to determine the amount of malodor on a fabric swatch.

The analysis is conducted with a Gas Chromatograph 7890B equipped with a Mass Selective Detector (MSD) (5977B) and Chemstation quantitation package, connected with a Gerstel Multi-Purpose sampler equipped with a solid phase micro-extraction (SPME) probe and with a DB-FFAP column Agilent part #122-3232. A Divinylbenzene/Carboxen/Polydimethylsiloxane SPME fiber from Supleco part #57298-U (or similar fiber) is used.

A malodor tracer is cut to a 2"×2.5" piece and placed in a 10 mL headspace crimp vial (Restek-part #21165-221). The tracer is allowed to equilibrate for 12 hours in the vial prior to GC-MS headspace SPME analysis.

GC-MS Parameters:

Gerstel Auto Sampler Parameters

- SPME: from Incubator
- Incubation Temperature: 80° C.
- Incubation Time: 90.00 min
- Sample Tray Type: VT32-10
- Vial Penetration: 22.00 mm
- Extraction Time: 20.00 min
- Inj. Penetration: 54.00 mm
- Desorption Time: 300 s GC Oven Parameter

- Front SS Inlet He
  - Mode Split
  - Heater: 250° C.
  - Pressure: 11.962 psi
  - Total Flow: 79.5 mL/min
  - Septum Purge Flow: 3 mL/min
  - Split Ratio: 50:1
  - GC Run Time: 22.5 min
- Oven
  - Initial temperature: 40° C.
  - Hold Time: 0 min
  - Heating Program
    - Rate: 12° C./min
    - Temperature: 250° C.
    - Hold Time: 5 min MSD Parameters Detection is run in scan mode with a minimum range of 40 to 350 m/z. A target ion for quantification is determined for each malodor component along with a minimum of 1 qualifier ion, preferably 2. The defined target and qualifier ions for each component must be based on an MSD compound library or standard.

Calibration curves are generated from standards in mineral oil for each malodor material. Utilizing the calibration headspace response, the integration of the extracted ion (EIC) for each malodor component in the test samples is plotted or recorded and averaged across replicates.

Artificial body soil (ABS)-squalene oxidation markers have been specifically analyzed for and are summarized together in the data shown below. More specifically ABS-squalene oxidation markers used are 3-methylbutenal, 2-heptenal and 6-methyl-5-hepten-2-one.

Materials:

1) Preparation Malodor Tracers:

Malodor tracers are prepared by applying the freshly made malodor cocktail to polycotton (PC) (50/50) swatches in which fabric finishes applied to fabrics at the textile mill that could potentially cause interference are removed. The malodor cocktail is applied to 2×5 inch polycotton 50/50 swatches the same morning as the full scale runs are conducted. PC 50/50 swatches are supplied by APD (Accurate Product Development, global materials supplier located in Cincinnati, Ohio).

An Integra Viaflo Automatic Pipette is used to apply the malodor cocktail on the PC 50/50 swatches. A 96-channel head (8 rows of 12 tips) and 300 μl pipette tips are used. For this test 5 rows of 12 tips are used to apply the malodor cocktail on a fabric tracer. Each tip applies 15 μl on the fabric tracer. 16 malodor cocktail comprising fabric tracers are prepared and wrapped together in an Aluminium foil for storage till beginning of the washing test.

2) Malodor Cocktail Composition:

The following malodor cocktail has been prepared through mixing of the individual compounds:

| Malodor cocktail | Order Of Addition | weight (g) |
|---|---|---|
| Malodor core (see below) | 1 | 29.25 |
| ABS from APD | 2 | 27 |
| Squalene (CAS: 111-02-4) | 3 | 27 |

| Malodor core | CAS-number | Order Of Addition | % Comp |
|---|---|---|---|
| Undecanoic Acid | 112-37-8 | 1 | 62.80 |
| Decanoic Acid | 334-48-5 | 2 | 22.00 |
| Skatole | 83-34-1 | 3 | 1.00 |
| Iso Valeric acid | 503-74-2 | 4 | 12.00 |
| Ethyl undecanoate | 627-90-7 | 5 | 2.00 |
| Undecanal | 112-44-7 | 6 | 0.20 |

EXAMPLES

The examples provided below are intended to be illustrative in nature and are not intended to be limiting. As shown in the tables below, the inclusion of polyalkyleneamine such as polyethyleneimines in specific amounts may surprisingly both reduce malodor while not increasing yellowing of the fabrics.

Example 1. Exemplary Formulations (Heavy-Duty Liquid Laundry Detergents)

The following heavy-duty liquid laundry detergent compositions may be prepared by traditional means known to those of ordinary skill in the art by mixing the listed ingredients Table 1. Composition 1A is a conventional premium laundry detergent that contains no polyalkyleneamine of the present disclosure. Compositions 1B-1E are prepared from Composition 1A by incorporating various chelants at different levels as indicated in Table 2.

TABLE 1

Ingredients in Composition 1A

| Raw Material | 1A Active Wt % (comp) |
|---|---|
| C12-15 alkyl ethoxy (1.8) sulfate | 11.7 |
| Alkyl benzene sulfonate[1] | 7.2 |
| C12-14 Amine Oxide | 0.7 |
| C12-14 EO9[2] | 5 |
| Citric Acid | 2.1 |
| C12-18 Fatty Acid | 0.9 |
| Sodium hydroxide | 0.2 |
| Chelant[3] | 0.47 |
| Monoethanolamine (MEA) | 2.9 |
| Diethylene glycol (DEG) | 2.4 |
| 1,2-Propanediol | 2.1 |
| Borate | 1 |
| Ethanol | 1.5 |
| Sorbitol | 0.06 |
| Sodium Cumene Sulfonate | 0.15 |
| Ethoxylated Polyethyleneimine[4] | 1.5 |
| Amphiphilic alkoxylated grease cleaning polymer[5] | 1.3 |
| Calcium formate | 0.1 |
| Sodium Chloride | 0.03 |
| Protease[6] | 0.068 |

TABLE 1-continued

Ingredients in Composition 1A

| Raw Material | 1A Active Wt % (comp) |
|---|---|
| Mannanase[7] | 0.002 |
| Amalyse[7] | 0.007 |
| Fluorescent Whitening Agents[8] | 0.3 |
| V200 Whiteness Dye | 0.025 |
| Perfume | 0.6 |
| Hydrogenated Castor Oil | 0.1 |
| Phenoxyethanol | 0.001 |
| Benzisothiazolinone | 0.001 |
| Aesthetic dye | 0.01 |
| DC1520 Silicone Suds suppressor | 0.003 |
| AF8017 Silicone Suds suppressor | 0.2 |
| Water/Misc. | Balance |

[1]Linear alkylbenzenesulfonate having an average aliphatic carbon chain length C11-C12 supplied by Stepan, Northfield, Illinois, USA

[2]AE9 is C12-14 alcohol ethoxylate, with an average degree of ethoxylation of 9, supplied by Huntsman, Salt Lake City, Utah, USA

[3]Diethylenetetraamine pentaacetic acid (DTPA) supplied by Dow Chemical, Midland, Michigan, USA; Hydroxyethane diphosphonate (HEDP) supphed by Solutia, St Louis, Missouri, USA Bagsvaerd, Denmark, may also be used

[4]Polyethyleneimine (MW = 600) with 20 ethoxylate groups per-NH.

[5]Amphiphilic alkoxylated grease cleaning polymer is a polyethyleneimine (MW = 600) with 24 ethoxylate groups per-NH and 16 propoxylate groups per-NH.

[6]Proteases may be supplied by Genencor International, Palo Alto, California, USA (e.g. PurafectPrime ®) or by Novozymes, Bagsvaerd, Denmark (e.g. Liquanase ®, Coronase ®).

[7]Natalase ®, Mannaway ® are all products of Novozymes, Bagsvaerd, Denmark.

[8]Suitable Fluorescent Whitening Agents are for example, Tinopal ® AMS, Tinopal ® CBS-X

Example 2. Malodor Control of Additional Chelants

The compositions 1A-1E are tested for Oxidation Markers according to the test method provided herein. Results are included in Table 2.

TABLE 2

Additional Chelants and levels employed in Compositions 1B-1GE

| Composition | Chelant Type | Chelant Amount % in Product | Chelant Amount ppm TTW | ABS/Squalene Markers (nmoles/L) |
|---|---|---|---|---|
| 1A | n/a | 0.00% | 0 | 33 |
| 1B | EDDS | 0.10% | 2.5 | 40.2 |
| 1C | EDDS | 0.50% | 12.5 | 31 |
| 1D | PEI 800 | 0.10% | 2.5 | <10 |
| 1E | PEI 800 | 0.50% | 12.5 | <10 |

The inclusion of polyalkyleneamine in the form of PEI 800 at levels between 0.1% and 1.1% by weight of the composition (Compositions 1D and 1E) exhibits improved malodor control resulting in ABS/Squalene Oxidation Markers of less than 10 nmoles/Liter. This is unlike the control samples without additional chelant (1A) or the use of EDDS as an additional chelant (1B and 1C).

Another chelant structure, C12-substituted diethylenetriamine (C12-DETA, $N^1$-(2-aminoethyl)-$N^1$-dodecyl-1,2-ethanediamine, CAS No. 4182-44-9, structure shown below), was tested in Composition 1F and 1G for malodor reduction against reference composition 1A', which is very similar to composition 1A above. Compositions 1F and 1G were prepared by adding C12-DETA to Composition 1A' at the levels indicated in Table 3.

C12-DETA

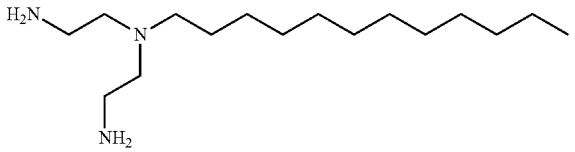

TABLE 3

Malodor reduction benefit of C12-DETA

| Composition | Chelant Type | Chelant Amount % in Product | ABS/Squalene Markers (nmoles/L) |
|---|---|---|---|
| 1A' | n/a | 0.00% | 202 |
| 1HF | C12-DETA | 0.25% | 51 |
| 1G | C12-DETA | 0.75% | 7 |

Addition of C12-DETA to the heavy-duty liquid detergent resulted in compositions that significantly reduced the total Oxidation markers on fabrics treated with these compositions, relative to the amount of oxidation markers found in fabrics treated with a composition absent such chelant.

Example 3. PEI-800 Impact on Multi-Cycle Whiteness

To show the effect that PEI-800 (and % levels thereof) can have on whiteness, certain amounts are added to North American liquid TIDE® (a commercially available heavy-duty liquid laundry detergent, Trial 3A) as provided in Table 3. Various fabrics (polycotton, cotton, polyester, and consumer (medium and heavy) dingy) are treated under North American conditions for ten wash cycles with the compositions.

After ten cycles, whiteness losses are determined according to the Whiteness Loss Test Method, as provided above in the Test Methods section. Results are provided in Table 4. Negative numbers show whiteness losses, with numbers of greater magnitude indicating greater whiteness losses (e.g., −10 indicates more whiteness loss than −5). It is preferred that the whiteness losses are between 0 and −5, or between 0 and −4. Whiteness losses that are greater in magnitude indicate that the product may be less preferred for consumer use.

TABLE 4

ΔΔWI vs REF for various levels of PEI-800 in North American liquid TIDE ®

| Trial | PEI-800 (wt %) | Polycotton | Cotton | Polyester | Dingy (M) | Dingy (H) |
|---|---|---|---|---|---|---|
| 3A | — | 0.0 | 0.0 | 0.0 | 0.0 | 0.0 |
| 3B | 0.1 | −4.25 | −2.25 | 4.67 | −2.67 | −2.19 |
| 3C | 0.2 | 1.09 | −3.16 | 5.17 | −1.70 | −3.48 |
| 3D | 0.5 | −3.93 | −3.78 | 4.73 | −7.29 | −4.50 |
| 3E | 1.2 | −15.45 | −7.15 | −7.87 | −21.94 | −10.72 |

As shown in Table 3, the presence of polyamines at high levels may result in unacceptable whiteness losses upon multiple treatments. However, the whiteness losses provided by lower levels of polyamines (see Trials 3B-3D) are relatively acceptable to a manufacturer. By way of comparison, Trial 3E, which includes PEI-800 at a level of 1.2%, shows whiteness losses that are believed to be less preferred.

As discussed and shown above, it has been surprisingly found that polyethyleneimines should not be used in amounts greater than 1.5% by weight of detergent formulation. Without being bound by theory, it is believed that in an anionic ingredient system, pairing of PEI with anionic ingredients (anionic surfactants) as well as soaps (carboxylates) or other charged species (polycarboxylates) tends to lower the solubility and activity of PEI as well as reduce the activity of the anionic ingredient system.

It should be noted that linear polyethyleneimines as well as mixtures of linear and branched polyethyleneimines are useful in the compositions of the present invention. Linear PEI's may be obtained by cationic polymerization of oxazoline and oxazine derivatives. Methods for preparing linear PEI (as well as branched PEI) are more fully described in Advances in Polymer Science, Vol. 102, pgs. 171-188, 1992 (references 6-31) which is incorporated in its entirety herein by reference.

The level of PEI used in the compositions of the present invention is from about 0.01% to about 1.1%, preferably from about 0.02% to about 0.5%, or from 0.03% to about 0.8%. The addition of PEI to the detergent compositions of the present invention unexpectedly results in the reduction of yellowing within the fabric. As shown in the table below, higher levels of PEI, as exemplified by PEI-800, may result in increased yellowing of the fabrics. Specifically, as shown in the table above, the 1.2% PEI-800 treatment was significantly negative vs control on every fabric type. These findings are unexpected and have not been disclosed in the art.

Process of Making

Those skilled in the art will know how to make a water-soluble unit dose article and laundry detergent composition according to the present invention using techniques known in the art.

Use

A further aspect of the present invention is a use of an polyalkyleneaminepolyamine or salt thereof to reduce malodors on fabrics wherein the fabric comprises at least one source of malodor and the The polyalkyleneamine may be comprised of alkyleneamine moieties selected from a.

(M1)

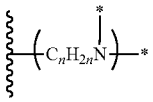

b.

(M2)

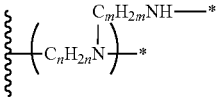

c.

(M3)

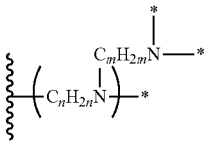

wherein for each alkyleneamine moiety, n is independently 2 or 3, preferably 2; m is independently 2 or 3, preferably 3; wherein the polyamine comprises at least one radical

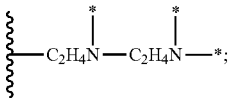

wherein

⊢ indicates a point of attachment either to (a) a N atom of another M1, M2, or M3, or to (b) $NG_2$;

—* indicates a point of attachment either to (a) a C atom of another M1, M2, or M3, or to (b) G;

each G independently is H or an organic capping group with MW less than 250, preferably H;

the number of M1 alkyleneamine moieties is an integer from about 1 to about 120,000, preferably from about 2 to about 60,000, more preferably from about 3 to about 24,000; the sum of the number of M2 and M3 alkyleneamine moieties is an integer from about 0 to about 60,000, preferably from about 1 or 2 to about 30,000, more preferably from about 3 to about 12,000.

A metal ion may be present in the source of malodor on the fabric before the fabric is combined to the wash liquor. If present in the wash liquor, the metal ion may be present in the laundry detergent, the water or a mixture thereof. The source of malodor may comprise the metal ion at the point the source of malodor is applied to the fabric. Alternatively, the source of malodor may be applied to the fabric and the metal ion applied later.

Preferably, the at least one source of malodor comprises a metal ion, more preferably $Cu^{2+}$.

A further aspect of the present invention is the use of a process according to the present invention to reduce malodor on fabrics in a wash liquor and wherein the fabrics comprise at least one source of malodor and wherein the wash liquor comprises a metal ion, preferably $Cu^{2+}$.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A process of reducing malodors on fabrics, comprising the steps of:

a. Combining fabrics with a wash liquor, wherein the fabrics comprise at least one source of malodor and copper ions, where the copper ions are present on the fabrics prior to being combined with the wash liquor, and wherein the wash liquor comprises one or more polyalkyleneamines, and wherein the wash liquor is prepared by diluting a laundry detergent composition in water by a factor of between 100- and 3000-fold;

b. Washing the fabrics in the wash liquor using an automatic wash operation, a manual wash operation or a mixture thereof;

c. Separating the fabrics and the wash liquor from one another;

wherein the laundry detergent composition comprises from about 0.01% to about 1.1% by weight of the laundry detergent of the polyalkyleneamine or salt thereof.

2. The process of claim 1, wherein the polyalkyleneamine comprises alkyleneamine moieties selected from a.

(M1)

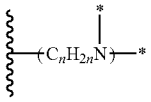

b.

(M2)

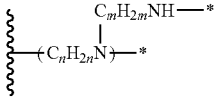

c.

(M3)

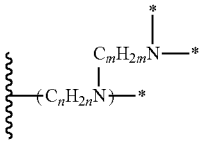

wherein for each alkyleneamine moiety, n is independently 2 or 3, m is independently 2 or 3, wherein the polyamine comprises at least one radical

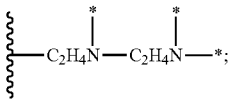

wherein

⊢ indicates a point of attachment either to (a) a N atom of another M1, M2, or M3, or to (b) $NG_2$;

—* indicates a point of attachment either to (a) a C atom of another M1, M2, or M3, or to (b) G;

each G independently is H or an organic capping group with MW less than 250;

the number of M1 alkyleneamine moieties is an integer from about 1 to about 120,000; the sum of the number of M2 and M3 alkyleneamine moieties is an integer from about 0 to about 60,000.

3. The process of claim 1, wherein the polyalkyleneamine comprises alkyleneamine moieties selected from a.

(M1)

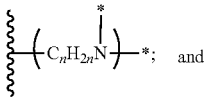

and b.

(M2)

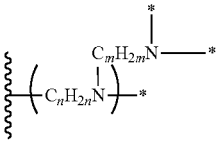

wherein for each alkyleneamine moiety, n is independently 2 or 3; m is independently 2 or 3;

wherein the polyamine comprises at least one radical

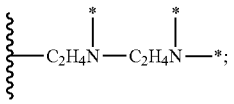

wherein indicates a point of attachment either to (a) a N atom of another M1 or M2, or to (b) $NG_2$;

—* indicates a point of attachment either to (a) a C atom of another M1 or M2, or to (b) G;

each G independently is H or an organic capping group with 1\4W less than 250; the number of M1 alkyleneamine moieties is an integer from about 2 to about 60,000; the number of M2 alkyleneamine moieties is an integer from about 1 to about 30,000.

4. The process of claim 2, wherein the polyalkyleneamine has a molecular weight between about 1,200 and about 50,000.

5. The process of claim 2, wherein the polyalkyleneamine is present in the laundry detergent composition at a level by weight of 0.025 to 1.0 wt %.

6. The process of claim 2, wherein the polyalkyleneamine may have no more than one organic capping group per three N atoms.

7. The process of claim 1, wherein laundry detergent composition comprises a plurality of polyalkyleneamines.

8. The process of claim 2, wherein the polyalkyleneamine comprises an n equal to 2 and an m equal to 2.

9. The process of claim 2, wherein the polyalkyleneamine comprises up to 10 M1 units and/or up to 10 M2 units.

10. The process of claim 2, wherein the polyalkyleneamine comprises up to 2 M1 units and/or up to 2 M2 units.

11. The process according to claim 2, wherein the fabrics are washed in the wash liquor at a temperature of between 10° C. and 45° C.

12. The process according to claim 11, wherein the wash operation in step b takes between 5 minutes and 60 minutes.

13. The process according to claim 1, wherein the laundry detergent composition comprises a chelant comprising phosphonates, aminocarboxylates, amino phosphonates, polyfunctionally-substituted aromatic chelating agents, or mixtures thereof.

14. The process according to claim 13, wherein the laundry detergent composition comprises an additional chelant selected from the group consisting of diethylenetriaminepentaacetic acid, hydroxyethanediphosphonic acid, ethylenediamine disuccinate, diethylene triamine penta (methylene phosphonic acid)), ethylene diamine tetra(methylene phosphonic acid), 1,2-diydroxybenzene-3,5-disulfonic acid, 2-pyridinol-N-oxide, methylglycinediacetic acid, glutamic-N,N-diacetic acid, EDTA; any suitable derivative thereof, salts thereof, and mixtures thereof.

15. The process according to claim 2, wherein the laundry detergent composition comprises a non-soap surfactant selected from anionic surfactant, non-ionic surfactant, amphoteric surfactant, cationic surfactant, or a mixture thereof, wherein the laundry detergent composition comprises from about 8% to about 60% by weight of the laundry detergent composition of the non-soap surfactant.

16. The process according to claim 15, wherein the non-soap anionic surfactant comprises linear alkylbenzene sulphonate, alkoxylated alkyl sulphate or a mixture thereof.

17. The process according to claim 16, wherein the weight ratio of linear alkylbenzene sulphonate to alkoxylated alkyl sulphate is from about 1.2:1 to about 10:1.

18. The process according to claim 17, wherein the laundry detergent composition comprises from about 0.01% to about 8% by weight of the laundry detergent composition of a non-ionic surfactant comprising an alcohol alkoxylate, an oxo-synthesised alcohol alkoxylate, a Guerbet alcohol alkoxylate, an alkyl phenol alcohol alkoxylate, or a mixture thereof.

19. The process according to claim 18, wherein the laundry detergent composition comprises an antioxidant.

* * * * *